US006223942B1

(12) United States Patent
Markey et al.

(10) Patent No.: US 6,223,942 B1
(45) Date of Patent: May 1, 2001

(54) CONTAINER AND CLOSURE

(75) Inventors: Kevin Joseph Markey, Westminster, MD (US); Frank Edward Gonda, Fairfield; James Lynn Turbett, Darien, both of CT (US); David Scott Laubach, New York, NY (US)

(73) Assignee: Lever Brothers Company, division of Conopco, Inc., New York, NY (US)

( * ) Notice: Subject to any disclaimer, the term of this patent is extended or adjusted under 35 U.S.C. 154(b) by 0 days.

(21) Appl. No.: 09/123,296

(22) Filed: Jul. 28, 1998

(51) Int. Cl.[7] ..... B65D 35/22
(52) U.S. Cl. ..... 222/94; 222/485; 222/556
(58) Field of Search ..... 222/94, 129, 485, 222/556, 563

(56) References Cited

U.S. PATENT DOCUMENTS

| | | | |
|---|---|---|---|
| D. 313,347 | 1/1991 | Fiore | D9/341 |
| D. 329,984 | 10/1992 | Walravens | D9/520 |
| D. 353,326 | 12/1994 | Abfier et al. | D9/341 |
| 3,269,389 | 8/1966 | Meurer et al. | 128/198 |
| 3,761,418 | 9/1973 | Parran, Jr. | 252/106 |
| 4,974,756 | 12/1990 | Pearson et al. | 222/562 |
| 5,052,590 | 10/1991 | Ratcliff | 222/94 |
| 5,137,178 | 8/1992 | Stokes et al. | 222/94 |
| 5,152,432 | 10/1992 | De Laforcade | 222/145 |
| 5,158,209 | 10/1992 | Reil et al. | 222/129 |
| 5,244,120 | 9/1993 | O'Meara | 222/94 |
| 5,252,312 | 10/1993 | Gentile et al. | 424/44 |
| 5,269,441 | 12/1993 | O'Meara | 222/94 |
| 5,289,949 | 3/1994 | Gentile | 222/137 |
| 5,289,950 | 3/1994 | Gentile | 222/142.3 |
| 5,312,934 | 5/1994 | Letton | 554/98 |
| 5,316,159 | 5/1994 | Douglas et al. | 215/10 |
| 5,318,203 | 6/1994 | Iaia et al. | 222/94 |
| 5,386,928 | 2/1995 | Blette | 222/94 |
| 5,389,279 | 2/1995 | Au et al. | 252/108 |
| 5,392,947 | 2/1995 | Gentile | 220/665 |
| 5,489,046 | 2/1996 | Wickham | 222/184 |
| 5,612,307 | 3/1997 | Chambers et al. | 510/406 |
| 5,615,803 | 4/1997 | Hatakeyama et al. | 222/94 |
| 5,626,262 | 5/1997 | Fitten et al. | 222/184 |
| 5,628,429 | 5/1997 | Usen et al. | 222/94 |
| 5,702,033 * | 12/1997 | Beaver | 222/94 |
| 5,921,440 * | 7/1999 | Maines | 222/94 |
| 5,931,356 * | 8/1999 | Lillelund et al. | 222/485 |
| 5,964,539 | 10/1999 | Yamaguchi et al. | 400/120.16 |

FOREIGN PATENT DOCUMENTS

| | | | |
|---|---|---|---|
| 42 16 191 | 11/1993 | (DE) . | |
| 297 17 244 U | 1/1998 | (DE) . | |
| 807 471 | 11/1997 | (EP) . | |
| 2 179 075 | 2/1987 | (GB) . | |
| 279064 * | 11/1989 | (JP) | 222/556 |
| 98/29320 | 7/1998 | (WO) . | |

* cited by examiner

*Primary Examiner*—Joseph A. Kaufman
(74) *Attorney, Agent, or Firm*—Gerard J. McGowan, Jr.

(57) ABSTRACT

A container for dispensing two products kept separate prior to application, for example, surfactant and skin benefit agent. The container comprising two chambers, adhered to each other. Although the chambers are essentially identical when viewed from their respective distal walls, they are adhered to each other at an offset so that from any view, both chambers can be seen. Preferably, the chambers include in their proximal walls complementary raised and recessed portions, e.g., protuberances and depressions, which assist the alignment of the chambers in an offset. A closure preferably comprises a peripheral flange and a wall extending transversely of the flange and including at least two product egress openings. Product egress channels on the underside of the transverse wall may lead to the product egress openings. Preferably attached to the closure base, for example by a hinge, is a closure cover. In accordance with one aspect of the invention, both the closure base transverse wall and the closure cover include one or more drainage openings. The drainage openings are not in communication with the product exit openings of the chambers, but instead serve to permit drainage of any liquid which may otherwise be present in the closure, given that the closure will receive the exteriors of the chambers, but not in a liquid tight arrangement.

32 Claims, 5 Drawing Sheets

FIG.5
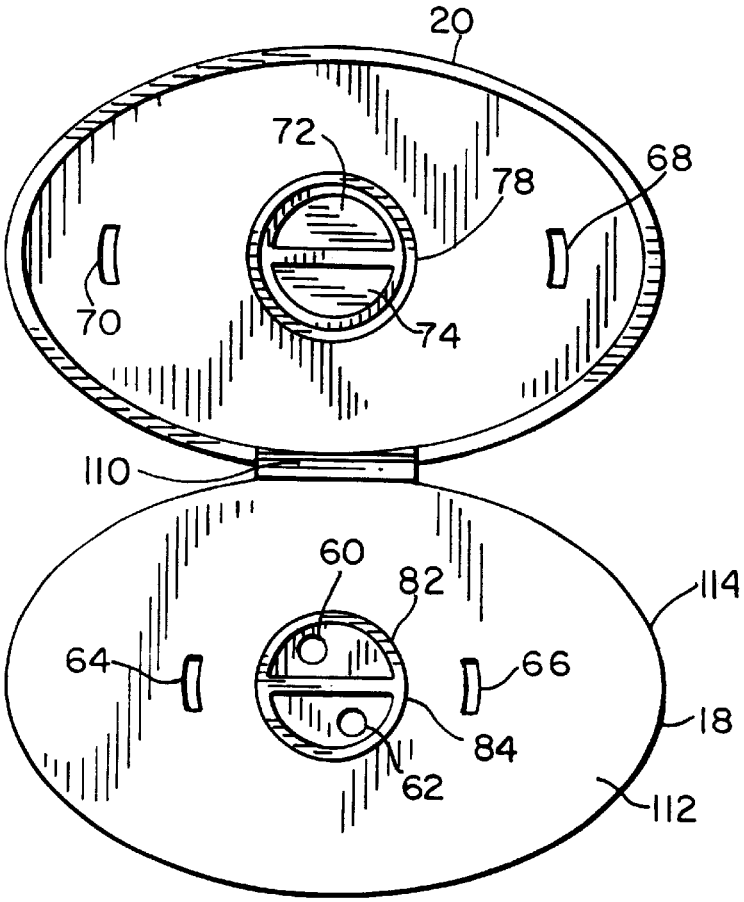
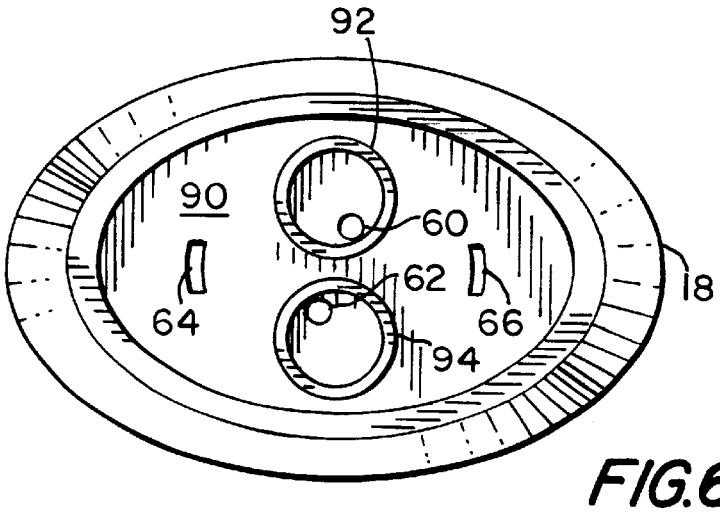
FIG.6

FIG. 7
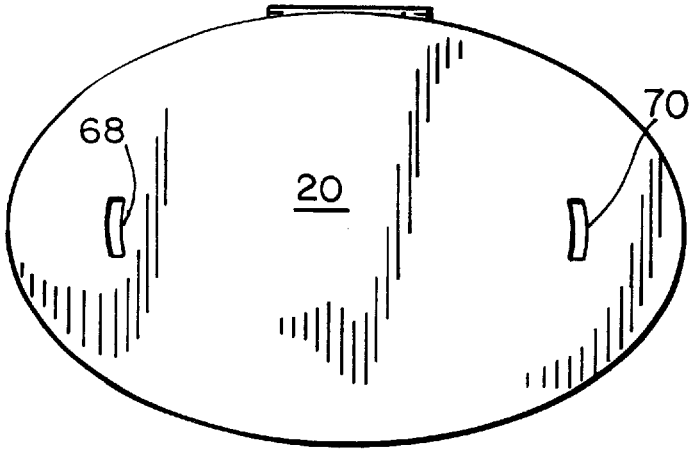
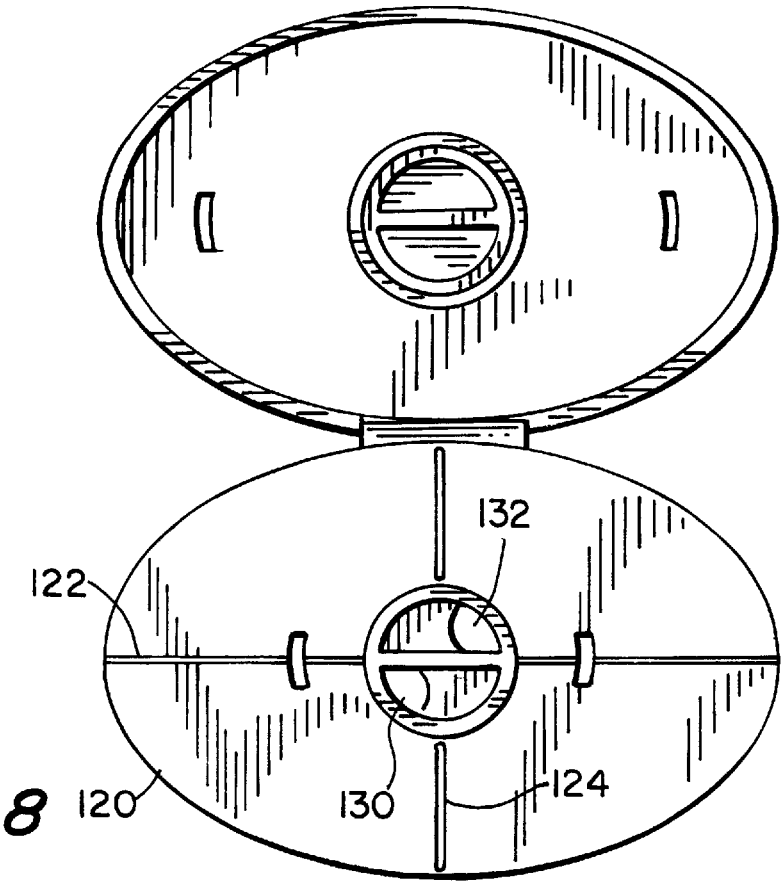
FIG. 8

CONTAINER AND CLOSURE

BACKGROUND OF THE INVENTION

It is often desirable in consumer and other products to keep separate two or more components of the composition until actual use. Examples of compositions wherein this may be desirable include personal washing compositions wherein cleansing and moisturizing compositions are kept separate prior to application on the skin by the consumer. Other examples include laundry products wherein it is desirable to keep separate enzyme and bleach, and dental products wherein it may be necessary to isolate peroxide from bicarbonate prior to use of the product. A patent disclosing such a personal washing composition is Chambers et al., U.S. Pat. No. 5,612,307. Another application for such containers is to house shampoo in one compartment and conditioner in another.

Numerous patents disclosing dual containers of one sort or another and/or closures have been published. These include Usen et al., U.S. Pat. No. 5,628,429, Hatakeyama et al., U.S. Pat. No. 5,615,803, Blette, U.S. Pat. No. 5,386,928, Iaia et al., U.S. Pat. No. 5,318,203, Douglas et al., U.S. Pat. No. 5,316,159, O'Meara, U.S. Pat. No. 5,269,441, O'Meara, U.S. Pat. No. 5,244,120, Reil et al., U.S. Pat. No. 5,158,209, De Laforcade, U.S. Pat. No. 5,152,432, Stokes et al., U.S. Pat. No. 5,137,178, Ratcliff, U.S. Pat. No. 5,052,590, Pearson et al., U.S. Pat. No. 4,974,756, Gentile U.S. Pat. No. 5,392,947, Mueller U.S. Pat. No. 5,964,539, Gentile U.S. Pat. No. 5,252,312, Gentile U.S. Pat. No. 5,289,949, Gentile U.S. Pat. No. 5,289,950, Abfier et al. U.S. Pat. No. Des. 353,326, Wickham U.S. Pat. No. 5,489,046, Walravens U.S. Pat. No. Des. 329,984 and Meurer et al., U.S. Pat. No. 3,269,389.

Despite the various dual containers disclosed in the literature, a dual container, especially for consumer products, which is simple and acceptable to consumers has been elusive.

SUMMARY OF THE INVENTION

The invention is directed to a simple, economical, efficient container for dispensing two products kept separate prior to application, for example, surfactant and skin benefit agent. In one aspect, the invention relates to a container comprising two chambers, each having a proximal wall and a distal wall. The chambers are adhered to each other at the proximal wall.

Although the chambers are essentially identical when viewed from their respective distal walls, they are adhered to each other at an offset so that from any view, both chambers can be seen. This is advantageous in that it permits the consumers to recognize that two separate chambers, and therefore, components, are used notwithstanding the fact that a unitary container is presented. Preferably, the chambers include in their proximal walls complementary raised and recessed portions, eg. protuberances and depressions, which assist the alignment of the chambers in an offset. Likewise, the chambers may be provided with generally longitudinally extending ridges or wedges, which facilitate joining of the chambers in an offset orientation.

Advantageously, the chambers of the present container are made of a material which permits the distal walls to be relatively flexible so as to permit a consumer to dispense the product merely by exerting pressure with one hand. A particularly preferred material is medium density polyethylene. In fact, preferably both chambers are made of medium density polyethylene, although softer materials may also be used. In one preferred embodiment, the ridge disposed on the proximal wall extends in a generally vertical orientation. Preferably aspects of the proximal walls medial to the ridge will be relatively flat, except for raised and recessed portions desirable to align the chambers, in order to permit the chambers to fit readily together. The chambers are preferably adhered together with a chemical adhesive.

An especially preferred alignment scheme comprises a generally vertically extending secondary ridge and a complementary generally vertically extending trough on each of the proximal walls.

Each chamber preferably includes a product exit opening. The product exit openings preferably lead to a closure, which constitutes a further aspect of the invention.

The closure preferably comprises a peripheral flange and a wall extending transversely of the flange and including at least two product egress openings. Product egress channels on the underside of the transverse wall may lead to the product egress openings. Preferably the product egress channels are in communication with and are snugly received within the product exit apertures of the chambers so that exiting product is directed from the chambers through the product egress channels to the respective product egress opening.

Preferably attached to the closure base, for example by a hinge, is a closure cover. The closure cover may include one or more plugs to assure that product does not escape through the product egress openings when the closure cover is closed.

In accordance with a particularly advantageous aspect of the invention, both the closure base transverse wall and the closure cover include one or more drainage openings. The drainage openings are not in communication with the product exit openings of the chambers, but instead serve to permit drainage of any liquid which may otherwise be present in the closure, given that the closure will receive the exteriors of the chambers, but not in a liquid tight arrangement. For instance, shower water can travel between the chambers and into the closure exterior to the product egress channels and the product exit apertures.

The cover of the closure preferably provides a relatively large surface area so that, if so desired, the container can be conveniently left to stand on the closure. This is particularly advantageous in the event that the components in the different chambers are consumed at different rates. By resting the container on its closure, the fluids in the various chambers will be caused by gravity to flow toward the closure and will then be positioned for use immediately upon opening of the container.

Medium density polyethylene is particularly preferred as the material from which the chambers are fabricated in that it is believed that it promotes even distribution of the product from the two chambers.

To promote stability when the container rests on its closure, the ratio of the area of the top surface of the closure to the cross sectional area of the container measured at its widest point is preferably high, especially 0.4 or above. Preferably the range is from 0.4 to 0.9, especially from 0.5 to 0.7. Providing a broad cap surface generally helps give the bottle better support.

For even dispensing, it is preferred that the viscosities of the liquids in each chamber be as close as possible to the other.

For a more complete understanding of the above and other features and advantages of the invention, reference should be made to the following detailed description of preferred embodiments and to the accompanying drawings.

BRIEF DESCRIPTION OF THE DRAWINGS

FIG. 5 is a top view of the closure according to the invention with the cover in the open position.

FIG. 6 is a bottom plan view of the closure of the present invention.

FIG. 7 is a top plan view of the closure of the invention with the cover closed.

FIG. 8 is a top plan view of a closure of the invention with the cover open.

DETAILED DESCRIPTION OF THE INVENTION

Container 10 comprises closure 12 and two chambers, 14 and 14'. Closure 12 includes base 18 and cover 20.

Figure 1:
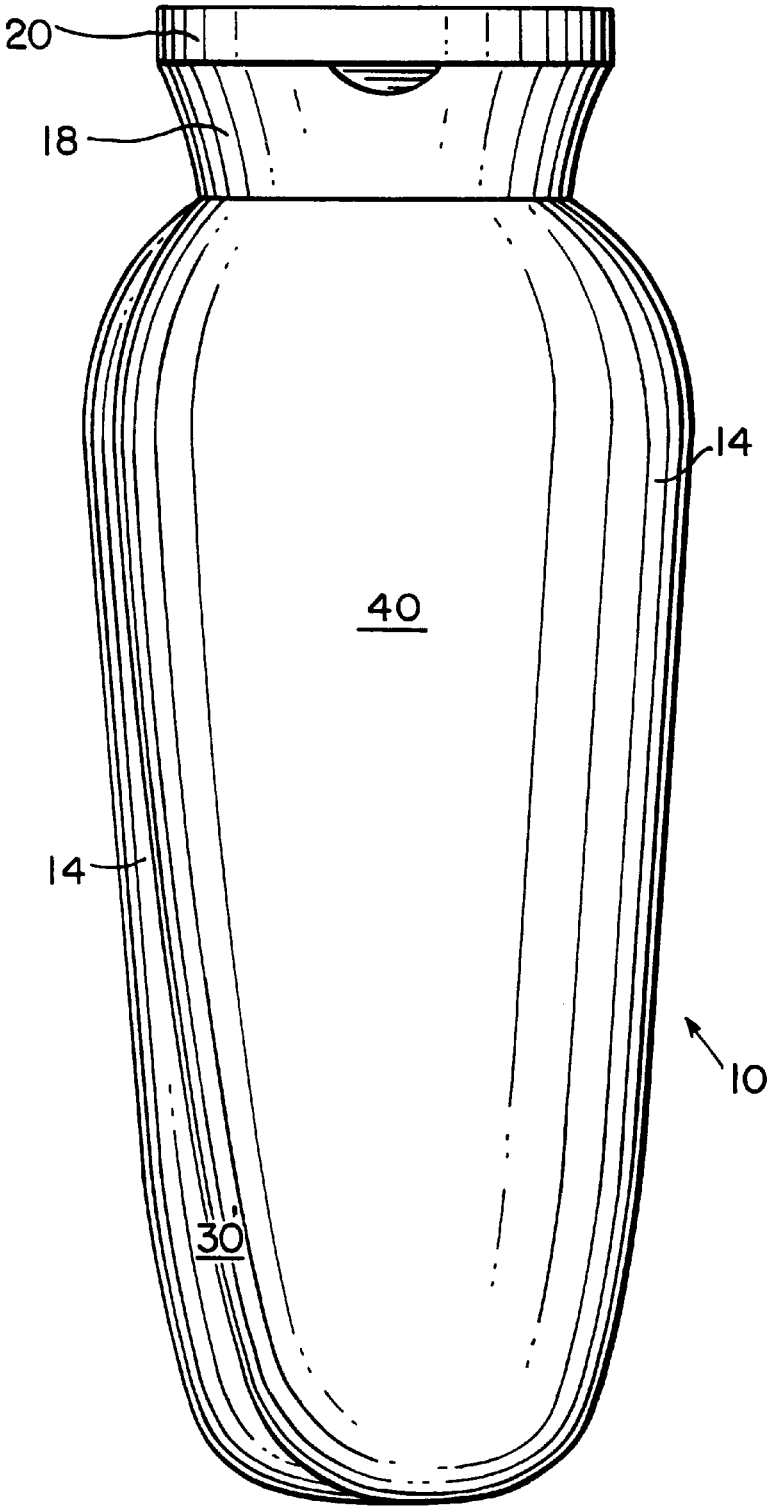
FIG. 1 is front elevational view of the container in accordance with the invention.
Figure 2:
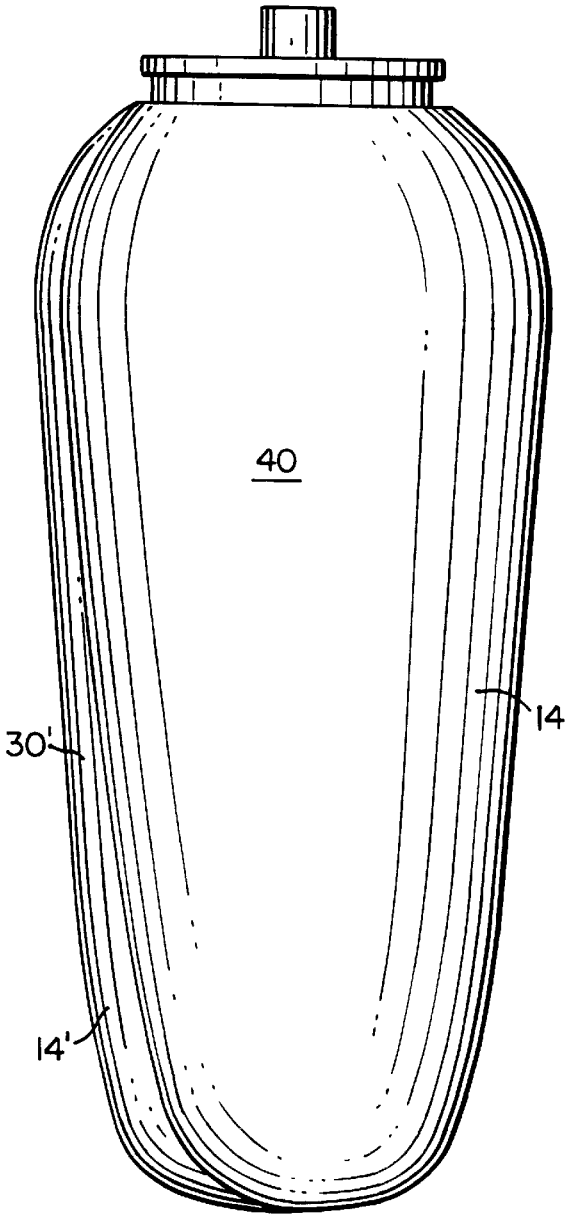
FIG. 2 is a front elevational view of the container according to the invention with the closure removed.
Figure 4A:
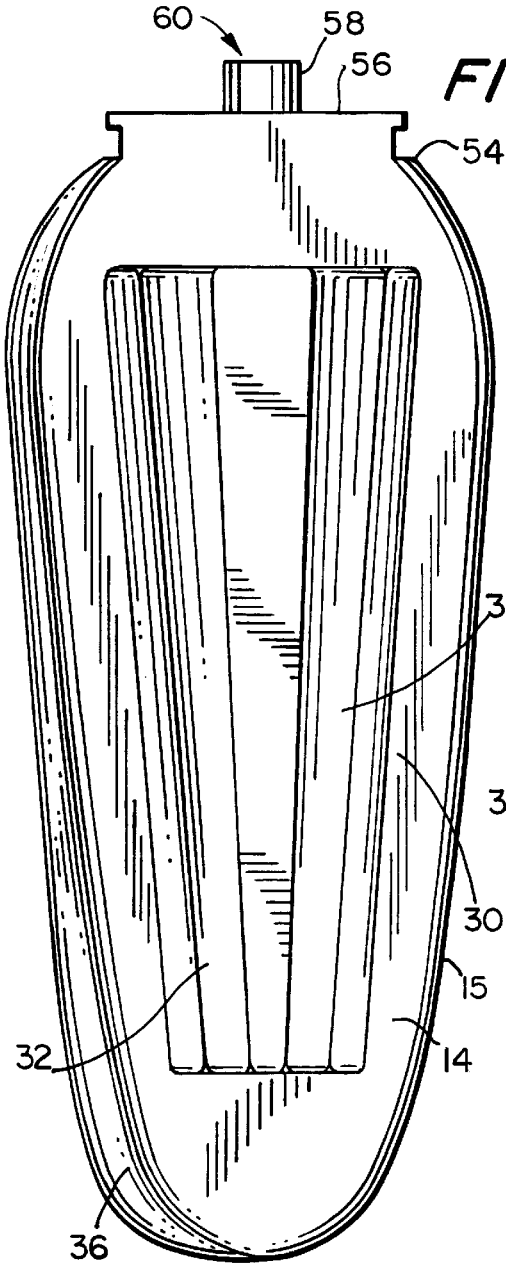
FIG. 4 is an elevational view of the proximal walls of the two chambers of the invention.
Figure 4B:
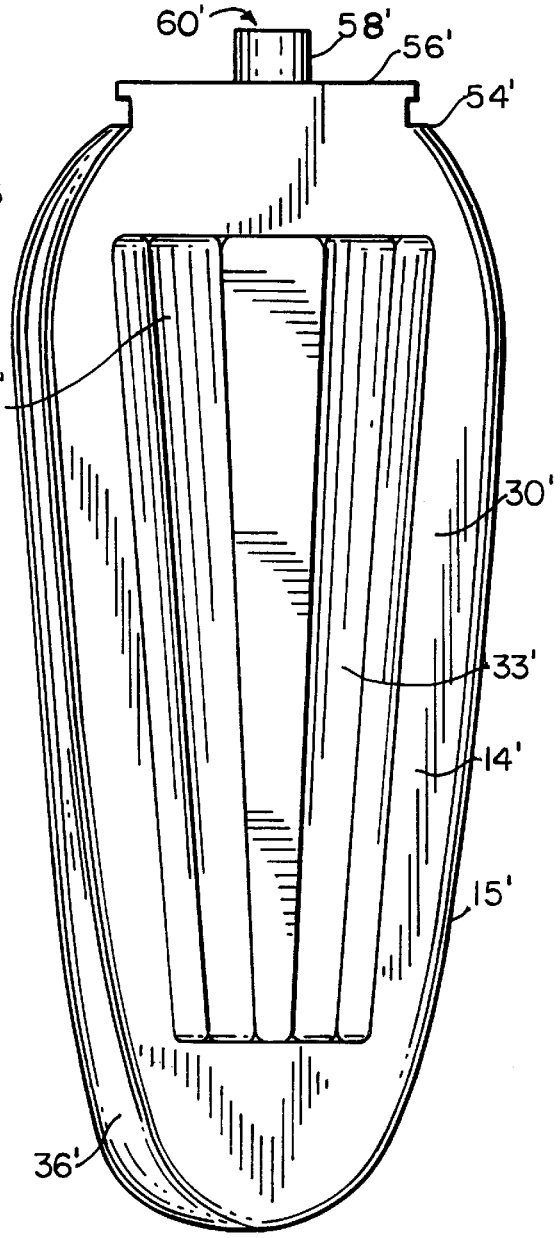

As especially seen in FIGS. 1, 2 and 4, although chambers 14 and 14' have transverse profiles and front plan views which are identical or essentially identical, they are disposed at an offset to each other so that from any view, even the front elevational view of FIGS. 1 and 4, both chambers can be seen. Thus, the fact that two separate chambers comprise the container can be readily ascertained by the consumer and the fact that two separate components are included can be readily deduced. The fact that two identical chambers may be used is advantageous, particularly in that manufacturing effort and costs can be minimized since only one chamber design, mold, etc. need be used.

Figure 3:
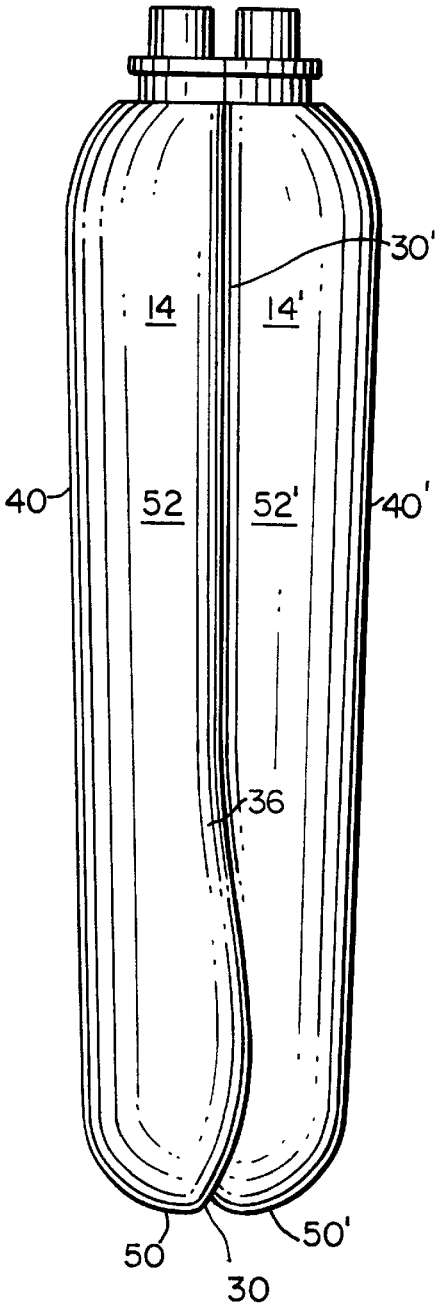
FIG. 3 is a side elevational view of the container according to the invention with the closure removed.

Chambers 14, 14' comprise proximal walls 30, 30' (see especially FIG. 4) at which the chambers are joined. Proximal walls 30 and 30' include ridges or wedges 36, 36' which extend generally vertically along one side of each of the proximal walls. These ridges assist in positioning the chambers so that they are offset. For instance, when the container is assembled so that proximal walls 30, 30' face and touch each other (see, especially, FIG. 3), ridges 36 and 36', respectively, are disposed laterally to rounded side edges 15', 15 (respectively) of side walls 52', 52 and serve to retain the side edges medially to the respective ridges. In addition, proximal wall 30 preferably includes raised areas and recesses such as vertically extending trough 33. Proximal wall 30' likewise preferably includes secondary ridge 32 and trough 33. Ridges 32, 32' receive troughs 33, 33' when the chambers are joined back to back along the proximal walls.

It will be appreciated that the ridges and troughs may of course be of a variety of shapes so long as they are complementary. For instance, male/female pin/hole arrangements could be used. The troughs and ridges or other recesses and protuberances are disposed on the proximal walls in positions such that the chambers 14, 14' will be offset as seen in FIG. 1.

Much of the region of proximal walls 30, 30' medial to ridges 36, 36', other than ridges 32, 32' and troughs 33, 33' is flat, or relatively so, in order to permit the chambers to adhere well to each other.

Opposite proximal walls 14, 14' are distal walls 40, 40'. These are the walls to which the consumer will apply pressure in dispensing the product and need not be as flat as the proximal walls. That is, they may be somewhat rounded. Distal walls 40, 40' are made of a flexible material which permits the consumer to apply pressure by merely moving his or her fingers together while holding the container in one hand. Preferably the distal walls, and in deed preferably each of the entire chambers, are made of medium density polyethylene. Especially preferred is polyethylene having a density of from about 0.926 to about 0.94 g/cc. It is believed that such densities of polyethylene promote uniform dispensing of product from both of the chambers simultaneously. Uniform dispensing of product is also promoted by ensuring that the viscosities of the products in the chambers are identical, or as close to each other as possible.

Chambers 14, 14' also include bottom walls 50, 50', a first shoulder 54, 54', a second shoulder 56, 56' and a finish 58, 58' leading to product exit opening 60, 60'.

Base 18 of closure 12 includes product egress openings 60, 62 and drainage apertures 64, 66. Cover 20 includes cover drainage openings 68, 70, plugs 72, 74 and inner flange 78. Plugs 72, 74 are accommodated within half moon flanges 82, 84 to help seal the container when the cover is in the closed position. Likewise flange 78 surrounds the two half moon flanges 82, 84 to keep the product from exiting the container when the container is closed.

Depending from the underside 90 of closure 18 are product egress channels 92, 94, which lead respectively to product egress openings 60, 62 in chambers 14, 14'. The channels serve to direct product from chamber finishes 58, 58' to product egress openings 62, 60, without permitting any extraneous liquid, e.g., shower water, to enter the product streams. Extraneous liquid travels through drainage openings 64, 66 in base 18 and through product drainage openings 68, 70 in cover 20 when the cover is closed. Extraneous shower water and other liquid are best avoided for aesthetic and hygienic reasons.

The closure is preferably a flip t op type closure wherein the base 18 and the cover 20 are connected by hinge 110 which is of the flip top type. Preferably the closure is injection molded and is made of polypropylene.

The chambers are filled through the product exit openings 60, 62 in the chambers prior to snap fitting the closure onto shoulders 56, 56'. The product egress openings 60, 62 are disposed in wall 112, which extends transversely of base flange 114.

In accordance with a preferred embodiment illustrated in FIG. 8, closure base 120 includes a longitudinal or major axis 122 and a minor or transverse axis 124. Advantageously, product egress openings 130, 132 are substantially disposed on opposite sides of both axes. This permits the user better to distinguish the dual product streams.

The dual chamber or "tottle" arrangement of the present invention provides positioning, alignment and proportioning for proper consumer ergonomics and dispensing, as compared to side to side positioning. The orientation and proportioning also allows a front and back label area for retail merchandising.

Preferably the container of the invention is used to receive a liquid personal wash cleaning formulation which includes a surfactant. Desirably the cleaning formulation also includes a skin conditioning and moisturizing ingredient. Preferably one chamber contains a surfactant composition and the other chamber includes a moisturizing composition.

The surfactant should be a relatively mild surfactant suitable for washing human skin and may be, e.g., an anionic, amphoteric, cationic or nonionic surfactant. It is preferred that the surfactant is a foaming surfactant. Among the mild surfactants which may be used are cocamidopropyl betaine, and sodium lauroamphoacetate, sodium cocoylisethionate. Among other surfactants which may be used are soap and sodium laureth sulfate.

Preferably surfactants are employed such that the surfactant, if used alone, or the surfactant mixture is milder than would be soap itself as measured by the zein solubilization test (soap yields 80% zein solubilized). Preferably the zein solubilization is less than 60%.

Among suitable anionic co-actives are the alkyl ether sulfates, acyl isethionates, alkyl ether sulfonates, sarcosinates, sulfosuccinates, taurates and combinations thereof. Among suitable amphoteric co-actives may be included alkylbetaines, amidopropyl betaines, amidopropyl sultaines and combinations thereof.

Alkyl ether sulfates used in the present invention may be of the general formula $R—(OCH_2CH_2)_nOSO_3—M^+$ wherein R ranges from $C_8$–$C_{20}$ alkyl, preferably $C_{12}$–$C_{15}$ alkyl, n is an integer from 1 to 40,preferably from 2 to 9, optimally about 3, and $M^+$ is a sodium, potassium, ammonium or triethanolammonium cation.

Typical commercial co-actives of this variety are listed in the Table below:

| Trademark | Chemical Name | Physical Form | Manufacturer |
|---|---|---|---|
| Steol CS 330 | Sodium Laureth Sulfate | Liquid | Stepan |
| Standopol ES-3 | Sodium Laureth Sulfate | Liquid | Henkel |
| Alkasurf ES-60 | Sodium Laureth Sulfate | Paste | Alkaril |
| Cycloryl TD | TEA Laureth Sulfate | Paste | Cyclo |
| Standapol 125-E | Sodium Laureth-12 Sulfate | Liquid | Henkel |
| Cedepal TD407MF | Sodium Trideceth Sulfate | Paste | Miranol |
| Standopol EA-2 | Ammonium Laureth Sulfate | Liquid | Henkel |

Alkyl ether sulfonates may also be employed in the present invention. Illustrative of this category is a commercial product known as Avenel S-150 commonly referred to as a sodium $C_{12}$–$C_{15}$ Pareth-15 sulfonate.

Another co-active type suitable for use in the present invention is that of the sulfosuccinates. This category is best represented by the monoalkyl sulfosuccinates having the formula $RO_2CCH_2CH(SO_3—Na^+)COO—M^+$; and amido-MEA sulfosuccinates of the formula: $RCONHCH_2CH_2O_2CCH_2CH(SO_3—M^+)COO—M+$; wherein R ranges from $C_8$–$C_{20}$ alkyl, preferably $C_{12}$–$C_{15}$ alkyl and $M^+$ is a sodium, potassium, ammonium or triethanolammonium cation. Typical commercial products representative of these co-actives are those listed in the Table below:

| Trademark | Chemical Name | Physical Form | Manufacturer |
|---|---|---|---|
| Emcol 4400-1 | Disodium Lauryl Sulfosuccinate | Solid | Witco |
| Witco C5690 | Disodium Cocoamido MEA Sulfosuccinate | Liquid | Witco |

-continued

| Trademark | Chemical Name | Physical Form | Manufacturer |
|---|---|---|---|
| McIntyre Mackanate CM40F | Disodium Cocoamido MEA Sulfosuccinate | Liquid | McIntyre |
| Schercopol CMSNa | Disodium Cocoamido MEA Sulfosuccinate | Liquid | Scher |
| Emcol 4100M | Disodium Myristamido MEA Sulfosuccinate | Paste | Witco |
| Schercopol | Disodium Oleamido MEA | Liquid | Scher |
| Varsulf S13333 | Disodium Ricionoleamido MEA Sulfosuccinate | Solid | Scherex |

Sarcosinates may also be useful in the present invention as a co-active. This category is indicated by the general formula $RCON(CH_3)CH_2CO_2—M^+$, wherein R ranges from $C_8$–$C_{20}$ alkyl, preferably $C_{12}$–$C_{15}$ alkyl and $M^+$ is a sodium, potassium ammonium or triethanolammonium cation. Typical commercial products representative of these co-actives are those listed in the Table below:

| Trademark | Chemical Name | Physical Form | Manufacturer |
|---|---|---|---|
| Hamposyl L-95 | Sodium Lauroyl Sarcosinate | Solid | W. R. Grace |
| Hamposyl TOC-30 | TEA Cocoyl/Sarcosinate | Liquid | W. R. Grace |

Taurates may also be employed in the present invention as co-actives. These materials are generally identified by the formula $RCONR'CH_2CH_2SO_3—M^+$, wherein R ranges from $C_8$–$C_{20}$ alkyl, preferably $C_{12}$–$C_{15}$ alkyl, R' ranges from $C_1$'$C_4$ alkyl, and $M^+$ is a sodium, potassium, ammonium or triethanolammonium cation. Typical commercial products representative of these co-actives are those listed in the Table below:

| Trademark | Chemical Name | Physical Form | Manufacturer |
|---|---|---|---|
| Igepon TC 42 | Sodium Methyl Cocoyl Taurate | Paste | GAF |
| Igepon T-77 | Sodium Methyl Oleoyl Taurate | Paste | GAF |

Within the category of amphoterics there are several general categories most suitable for the present invention. These include amphoacetate of the formula $RCONH(CH_2)_2N(CH_2COONa)CH_2CH_2OH$), alkylbetaines of the formula $RN^+(CH_3)_2CH_2CO_2—M^+$, amidopropyl betaines of the formula $RCONHCH_2CH_2CH_2N^+(CH_3)_2CH_2CO_2—M^+$, and amidopropyl sultaines of the formula $RCONHCH_2CH_2N^+(CH_3)_2CH_2SO_3—M^+$ wherein R ranges from $C_8$–$C_{20}$ alkyl, preferably $C_{12}$–$C_{15}$ alkyl, and $M^+$ is a sodium, potassium, ammonium or triethanolammonium cation. Typical commercial products representative of these co-actives are found in the Table below:

| Trademark | Chemical Name | Physical Form | Manufacturer |
|---|---|---|---|
| Tegobetaine F | Cocamidopropyl Betaine | Liquid | Goldschmidt |
| Lonzaine C | Cocamidopropyl Betaine | Liquid | Lonza |
| Lonzaine CS | Cocamidopropyl Hydroxysultaine | Liquid | Lonza |
| Lonzaine 12C | Coco-Betaine | Liquid | Lonza |
| Schercotaine MAB | Myristamidopropyl Betaine | Liquid | Lonza |
| Velvetex OLB-50 | Oleyl Betaine | Paste | Henkel |
| MacKen HPL 28 | Sodium Lauroamphoacetate | Liquid | McIntyre |

Within the broad category of liquid actives, the most effective are the alkyl sulfates, alkyl ether sulfates, alkyl ether sulfonates, sulfosuccinates, amidopropyl betaines and amphoacetates.

Another possible surfactant is an acyl isethionate having the formula

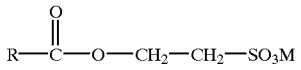

in which R denotes a linear or branched alkyl group and M denotes an alkali metal or alkaline earth metal or an amine.

Another surfactant which may be used are the monoalkyl or dialkylphosphate surfactants.

Another mild surfactant which may be used, preferably used as primary surfactant in combination with other surfactants noted above, is sodium coco glyceryl ether sulfonate. While desirable to use because of its mildness properties, this coco AGS alone does not provide optimum lather creaminess. A sodium 90/10 coconut/tallow alkyl AGS distribution is preferred for creaminess. Salts other than the sodium salt such as TEA-, ammonium, and K-AGS and chain length distributions other than 90/10 coconut/tallow are usable at moderate levels. Also, some soap may be added to improve lather volume and speed of lathering. Certain secondary co-surfactants used in combination with AGS can also provide a creamier and more stable lather. These secondary surfactants should also be intrinsically mild. One secondary surfactant that has been found to be especially desirable is sodium lauroyl sarcosinate (trade name Hamposyl L, made by Hampshire Chemical).

The amphoteric betaines, amphoacetates and sultaines noted above can be used as the sole surfactant, but are more preferred as a co-surfactant. Nonionics generally should not be used as the sole surfactant in this product if high foaming is desirable; however, they can be incorporated as a co-surfactant.

Nonionic and cationic surfactants which may be used include any one of those described in U.S. Pat. No. 3,761,418 to Parran, Jr., hereby incorporated by reference into the present application. Also included are the aldobionamides as taught in U.S. Pat. No. 5,389,279 to Au et al; and the polyhydroxy fatty acid amides as taught in U.S. Pat. No. 5,312,934 to Letton, both of which are incorporated by reference into the present application.

Soaps can be also be used. Preferably, soaps are used at levels of from about 1 to 10 wt % and at higher levels preferably where the surfactant mixture is milder than soap. The soaps may be added neat or made in situ via adding a base, e. g., NaOH; to convert free fatty acids. Preferably, soaps are only be used as cosurfactants to the extent that the surfactant system is milder than soap alone.

A preferred surfactant active system comprises an anionic (e.g., ammonium lauryl ether sulfate) at 1 to 15% by weight of the total composition and an amphoteric at 0.5 to 15% by weight of the total composition.

Preferably the surfactant or surfactant system is used in a liquid cleansing formulation having, for example, from about 10% to about 99% water.

The compositions of the invention preferably comprise anionic surfactants which are not nitrogen-containing anionic surfactants.

Moisturizers may include oils, cationic, and certain nonionic and anionic surfactants. Among the moisturizers which may be used are glycerine mono, di and tri-esters, vegetable oil, epidermal and sebaceous hydrocarbons such as lanolin, squalene, cholesterol and derivatives such as esters, mineral oil, silicone gum and silicone oil. One such moisturizer is the dimethicone emulsion sold as Dow Q2-1656, which is a 50% silicone emulsion. Other polyols which may be used include, but are not limited to glycerol, propylene glycol and polyethylene glycol. The moisturizer may be water-soluble or oil-soluble. In the latter case the overall composition may be an emulsion.

Other ingredients such as thickeners like ammonium sulfate and opacifiers such as mica/titanium dioxide may be used. Water, of course, may also be included.

The surfactant is preferably present at a level of from 2 to 50 wt. % of the total composition (ie. Including both chambers), especially from 5 to 25 wt. % of the cleansing composition. The moisturizing agent is preferably present at from 0.5 to 35 wt. %, especially from 2 to 20 wt. % of the total composition.

Further additional ingredients which may be employed include preservatives, pH adjusting agents such as citric acid and sodium hydroxide, perfumes, dyes, suspending agents such as magnesium/aluminum silicate, and sequestering agents such as EDTA.

The compositions held in the container can be applied to the skin by hand or by use of a personal washing implement such as a sponge, a loofah, a polymeric netted mesh pouf, etc.

EXAMPLE 1

The following formulations are held within the two chambers of the container illustrated in FIGS. 1–8. The chambers are made of medium density polyethylene and the closure is made of polypropylene.

| Full Chemical Name of CTFA Name | % Active Level in Formulation |
|---|---|
| Surfactant Chamber | |
| Sodiuim Laureth Sulphate | 9.0 |
| Sodium Lauroamphoacetate | 13.5 |
| Sunflower Seed Oil | 5.0 |
| Glycerol | 2.0 |
| Guar Hydroxypropyl trimonium Chloride | 0.5 |
| Lauric acid | 2.7 |
| Perfume | 1.0 |
| Opacifier | 0.1 |

-continued

| Full Chemical Name of CTFA Name | % Active Level in Formulation |
|---|---|
| PEG 80 Sorbiton Monolaurate | 2.0 |
| DMDM Hydantoin | 0.20 |
| Sequestrant | 0.04 |
| Citric Acid | 1.7 |
| Water | 62.06 |
| Benefit Chamber | |
| Sodium Laureth Sulphate | 4 |
| Sodium Lauroamphoacetate | 6 |
| Sunflower Seed Oil | 30.0 |
| Lanolin Alcohols + Cholesterol | 3.33 |
| Petrolatum | 2.5 |
| Glycerol | 9.00 |
| Guar Hydroxypropyl trimonium Chloride | 1.0 |
| Lauric Acid | 2.55 |
| Perfume | 1.0 |
| PEG 20 Sorbiton Monolaurate | 4.0 |
| DMDM Hydantoin | 0.20 |
| Sequestrant | 0.04 |
| Colorant | 0.00061 |
| Citric Acid | 0.7 |
| Water | 25.93 |

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A closure comprising a closure base having peripheral flange and a wail extending transversely of said flange, said wall including at least two product egress openings and at least one closure base drainage opening.

2. The closure according to claim 1 further comprising a cover adapted to prevent egress of fluid through said product egress openings and to permit drainage through said drainage opening and out of said closure.

3. The closure according to claim 2 wherein said cover is attached to said closure base.

4. The closure according to claim 2 further comprising at least two plugs depending from said cover adapted to be accommodated within, and to prevent egress of fluid from, said product egress openings.

5. The closure according to claim 1 wherein said at least one product drainage opening is disposed laterally to said product egress openings in said transversely extending wall.

6. The closure according to claim 1 wherein said wall includes a major axis extending from a first end thereof to an opposite end and a minor axis perpendicular thereto extending from a second end thereof to an opposite end wherein the distance from said first end along the major axis to the opposite end is at least 1.5 times the distance from said second end long the minor axis to the opposite end.

7. The closure according to claim 6 wherein at least one of said product egress openings is offset from minor axis.

8. The closure according to claim 1 further comprising a first product egress channel in communication with said first product egress opening, a second product egress channel in communication with said second product egress opening, said at least one closure base drainage opening being disposed outside of said first and second product egress channels.

9. The closure according to claim 1 wherein said cover further comprises at least one closure cover drainage opening.

10. The combination of the closure of claim 1 with at least a first and a second product chamber to form a container, wherein said first product chamber includes a first product exit opening and said second product chamber includes a second product exit opening, said first and second product exit openings are in communication with said first and second product egress channels and are not in communication with said at least one drainage opening.

11. The container of claim 10 wherein each of said first and second chambers is adhered to the other.

12. The container of claim 11 wherein said first and second chambers are comprised of medium density polyethylene.

13. The container of claim 10 wherein said first and second chambers each comprise a distal wall and a proximal wall, said chambers being adhered to each other at said first and second chamber proximal walls and said first and second chamber distal walls being sufficiently flexible to permit product dispensing by application of manual pressure thereto.

14. The container of claim 13 wherein said first and second chamber proximal walls each include at least one raised area and at least one recess, said first chamber raised area being received within said second chamber recess and said second chamber raised area being received within said first chamber recess.

15. The container of claim 14 wherein said first and second chamber proximal walls further comprise primary alignment ridges extending parallel to said product egress channels.

16. The container of claim 15 wherein said first and second chamber proximal walls are planar, in their aspects medial to said ridge.

17. The container according to claim 13 where said first chamber does not obscure said second chamber from any direction and said second chamber does not obscure said first chamber from any direction.

18. The container according to claim 10 wherein said closure is snap fit onto said first and second chambers.

19. A container comprising a first and a second product chamber, each chamber comprising a distal wall and a proximal wall, said chambers being adhered to each other at said first and second chamber proximal walls, said first and second chamber distal walls being sufficiently flexible to permit product dispensing by application of manual pressure thereto, aid chambers being similarly shaped so that said chambers could be disposed back to back along said proximal walls in a front view such that said distal wall of the first chamber will essentially obscure said second chamber and said distal wall of said second chamber will essentially obscure said first chamber, said chambers being adhered along said proximal walls in said container in an offset such that said first chamber does not obscure said second chamber from any direction and said second chamber does not obscure said first chamber from any direction.

20. The container of claim 19 wherein said first and second chambers are comprised of medium density polyethylene.

21. The container of claim 19 wherein said first and second chamber proximal walls each include at least one raised area and at least one recess, said first chamber raised area being received within said second chamber recess and said second chamber raised area being received within said first chamber recess, said raised area and recess being arranged to provide for said chamber offset.

22. The container of claim 19 wherein said first and second chamber proximal walls comprise primary alignment ridges extending parallel to said product egress channels, said primary alignment ridges being arranged to provide for said chamber offset.

23. The container of claim 22 wherein said first and second chamber proximal walls include planar aspects medial to said primary ridge.

24. The container according to claim 19 further comprising a closure snap fit onto said first and second chambers.

25. The container according to claim 10 wherein said first chamber comprises a surfactant and said second chamber comprises a skin benefit agent.

26. The container according to claim 25 wherein said skin benefit agent includes a moisturizer.

27. The container according to claim 19 wherein said first chamber comprises a surfactant and said second chamber comprises a skin benefit agent.

28. The container according to claim 27 wherein said skin benefit agent includes a moisturizer.

29. The container of claim 15 wherein said raised area is a generally vertically extending secondary ridge and said recess is a generally vertically extending trough.

30. The container of claim 22 wherein said raised area comprises a secondary generally vertically extending ridge.

31. The container according to claim 28 wherein the skin benefit agent chamber further comprises a surfactant.

32. The container according to claim 28 wherein the composition in the two chambers have different colors.

* * * * *